US005172557A

United States Patent [19]

Hubbell, Jr.

[11] Patent Number: 5,172,557

[45] Date of Patent: * Dec. 22, 1992

[54] BY PASS MANIFOLD VALVE FOR CHARGING REPAIRING AND/OR TESTING REFRIGERANT SYSTEMS

[76] Inventor: Paul J. Hubbell, Jr., P.O. Box 541, Metairie, La. 70004

[ * ] Notice: The portion of the term of this patent subsequent to Feb. 22, 2008 has been disclaimed.

[21] Appl. No.: 120,525

[22] Filed: Nov. 13, 1987

[51] Int. Cl.[5] ..... F25B 45/00

[52] U.S. Cl. ..... 62/77; 62/292

[58] Field of Search ..... 62/292, 77, 149, 298

[56] References Cited

U.S. PATENT DOCUMENTS 3,785,163 1/1974 Wagner ..... 62/292
3,916,641 11/1975 Mullins ..... 62/292
3,916,947 11/1975 Holmes et al. ..... 62/292 X
3,935,713 2/1976 Olson ..... 62/292
3,996,765 12/1976 Mullins ..... 62/292

*Primary Examiner*—Henry Bennett

[57] ABSTRACT

A device for servicing closed refrigerating systems comprising a double valve body with a transverse bore through a main shut off valve. The invention disclosed herein consist of methods for entering a closed refrigeration system for testing, charging and exiting the system, vacuum processes to vacuum the entire system and either the high or low sides of the system simultaneously and a method for the storage. The disclosed device and process eliminates a great percent of the loss of refrigerant in the refrigerant hoses when disconnecting during servicing and repairing the high side while using the recommended service techniques.

5 Claims, 3 Drawing Sheets

FIG 4
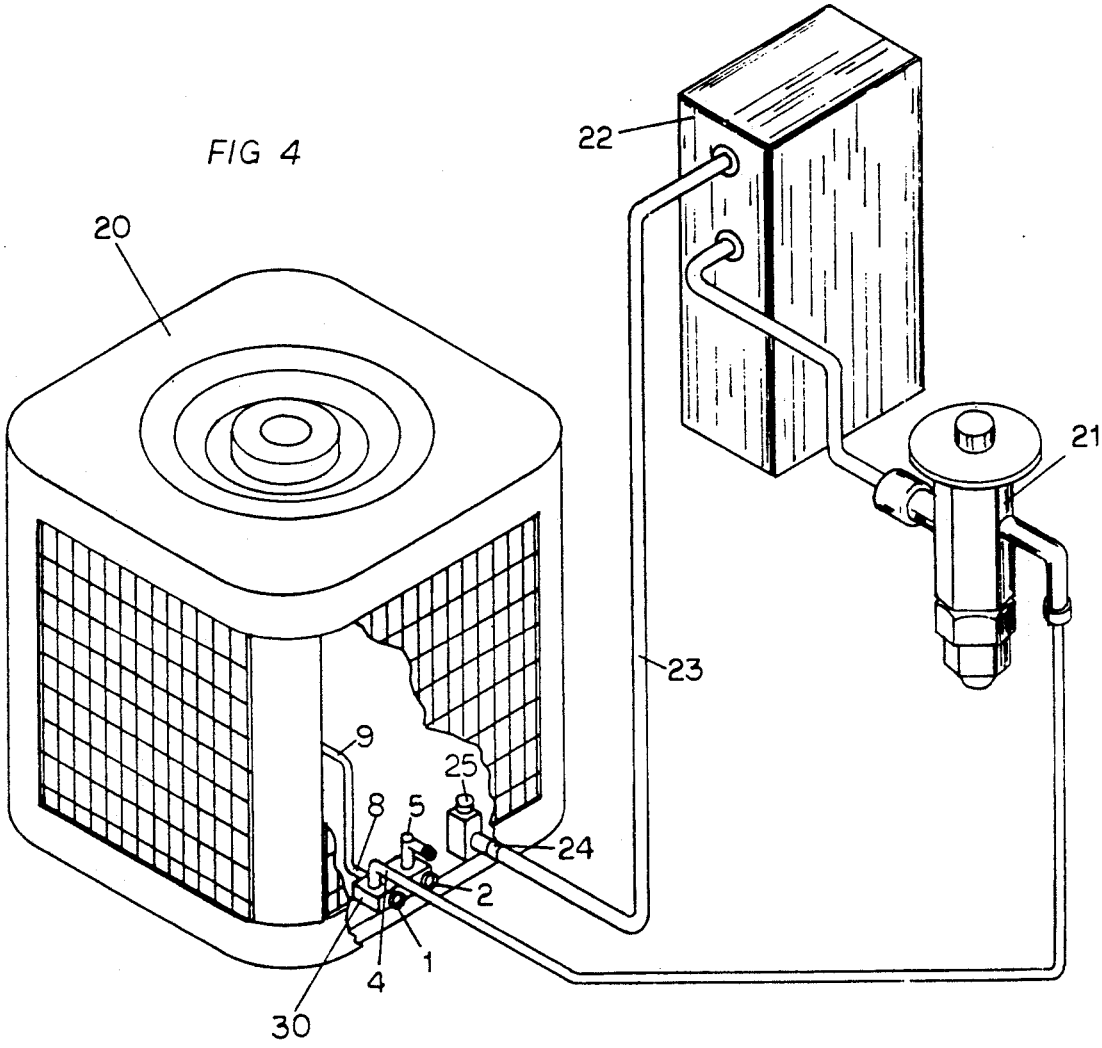
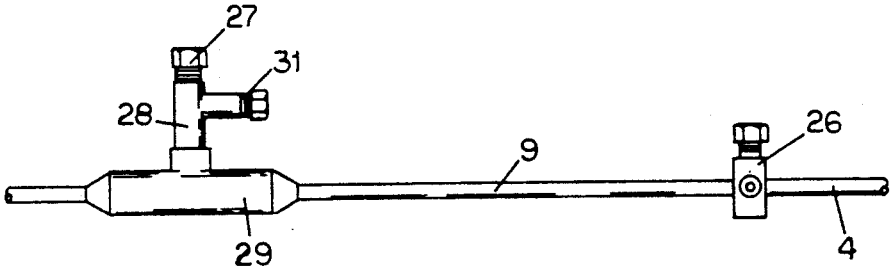
FIG 5

BY PASS MANIFOLD VALVE FOR CHARGING REPAIRING AND/OR TESTING REFRIGERANT SYSTEMS

BACKGROUND OF THE INVENTION

1. Field Of The Invention

The present invention relates to a closed refrigeration system with valved fittings having a plurality of capped threaded stems extending from two parallel elongated manifolds intersected by a transverse manifold, at a 90 degree angle, upstream from the liquid shut off valve and shut off seat of the main flow valve to create a by pass connection and, also, to a method for servicing, installing, testing or vacuuming the system and/or removing, storing or adding fluid refrigerant to the system.

The term "Refrigerating System", as used herein, relates to the current state-of-the-art systems that use compressible evaporative refrigerants to transfer heat, e.g., refrigerators, freezers and air conditioning units, including residential, commercial, automotive and other mobile types.

The maintenance of such systems requires that the refrigerant system be tested and additional refrigerant fluid be added thereto if the fluid contained in the system is below a predetermined pressure. Also, the refrigerant must sometimes be removed from the system in order to effect repairs and the system must then be recharged.

Installation, maintenance, testing and/or repairs of such pressurized systems and the infusion of additional refrigerant fluids to said systems require that a valve device or means be installed in the system to accomplish such work without the evaporative fluid in the enclosed space escaping from the system in order that the work can be performed in a safe, economical, efficient and environmentally protective manner.

The present invention, the "Hubbell-Double Valve", provides a means to accomplish the aforesaid purposes that is simple to install in said "Refrigerating System" and is simple to construct and inexpensive to manufacture.

2. Description Of Prior Art

Many refrigeration and air conditioning systems, especially residential and mobile, have threaded fittings in which a threaded check valve core is installed to provide access to the system. Such threaded check valves are of the type commonly used in automobile tire valve stems and are often referred to as "Schrader" type (depressing) valve cores. Most have no shut off valves, thus allowing a loss of refrigerant when connecting or disconnecting charging hoses, which results in unsafe, wasteful and harmful emissions into the atmosphere (causing Ozone depletion) in addition to unbalanced refrigerant charges in the system which causes the system to be inefficient. Present systems do not allow the independent vacuum process of both the condenser and evaporator section of the system simultaneously.

Other common problems, in proper maintenance and repair of refrigeration systems, are the means to check the system to determine the location of leaks and the inability to perform repairs or other work on the condenser unit without "blowing the charge" or venting the charge into the atmosphere.

The prior art contains a number of teachings of servicing tools and/or means to provide access to a closed refrigeration system, e.g., those disclosed in U.S. Pat. No. 3,935,713 issued to John W. Olson, U.S. Pat. No. 3,916,947 issued to Paul M. Holmes, U.S. Pat. No. 3,785,163 issued to William Wagner, U.S. Pat. Nos. 3,916,641 and 3,996,765 issued to John W. Mullins.

The invention of Olson discloses an external tool for the removal of Schrader type (depressing) valves; it is not installed in the system; it does not have a main flow shut off valve and it does not contain a by pass mechanism to gain access to the system.

The invention of Holmes has an access port with a Schrader valve, which this invention (the "Hubble-Double Valve") eliminates. It does not have a shut off valve on the access port. The valve access is not upstream of the main shut off valve and, therefore, a technician cannot isolate the refrigerant upstream of the main shut off valve to perform a by pass operation. It only has one shut off valve in the refrigerant flow line.

The invention of Wagner provides a refrigerant charging means and method for charging a saturated vapor refrigerant into the low pressure side of a refrigeration or air conditioning system. It discloses a portable external device which is not installed in the system, either at the factory or on-site at the location of the unit. It is a method of metering the charge. It does not allow a by pass operation and does not allow the isolation of the evaporator or condenser sections of the systems in order that the location of leaks may be more easily ascertained.

The inventions of Mullins disclose a spring and cam shaft to depress a valve core, a Schrader valve which is eliminated by the "Hubbell-Double Valve" disclosed herein. The Mullins invention discloses a portable external tool or device which is not in the unit system and which does not have a double valve that allows a by pass operation.

This invention, the "Hubbell Double Valve", addresses and solves the above mentioned problems, when used with the prescribed techniques, and provides other advantages over present means which will be further discussed hereinafter.

SUMMARY OF THE INVENTION

The present invention provides: (1) a simple manually operated by pass valve that eliminates the "Schrader" type valve, which, (2) is installed in the unit, thereby eliminating any external-type devices that are portable and prone to be misused or unused, such as in the hands of unscrupulous, "so-called" technicians and, (3) by preventing the emission of the refrigerant, practically eliminates the loss of refrigerant fluid when entering or exiting the refrigeration system, some of which "gases" contain chlorofluorocarbon (CFCs) and hydrochlorofluorocarbons (HCFCs) and which, when allowed to escape into the atmosphere, causes ozone depletion and may injure the technician servicing the system or other persons close by through inhalation of the refrigerant, "frost bite" or burns caused by said escaping refrigerants, and, (4) the by pass valve allows the refrigeration technician to place all of the refrigerant fluid in the condenser unit which then can be transferred to the evaporator section of the system, thus allowing the repair or work on either system separately; it also allows, (5) an independent vacuum process of the condenser or the evaporator sections of the system in order to be able to more easily locate leaks in the system and, (6) allows the evacuation of the refrigerant fluid from the hose between the gauge and the manifold access port of the by pass valve.

The present invention further eliminates easy access to a system and forces a mechanic to enter/exit a system with a manual front seat (by pass) valve, safely, thereby eliminating short cuts and saves the environment and improves energy use and eliminates waste of refrigerant; the by pass valve allows continuous operation of the system while entering and/or exiting the system without a system shut-down; it is less complicated and less risky than using a pump-down process required with two standard/Schrader type front seat service valves (Liquid & Suction); it eliminates the process tube silver solder joint on the exit of the present front seat valves and, when used on a suction line, it also eliminates the process tube to the compressor.

The by pass valve provided in this invention consists of a generally rectangular cast body provided with parallel longitudinal passageways which are intersected by a third longitudinal passageway which is transverse, at a 90 degree angle, to the parallel passageways, upstream of the shut off seat of the main flow valve and provides a by pass shut off service port for communication with the refrigerant system through a manifold service gauge (high, low and refrigerant drum connections for hoses). A "Schrader" less (non-depressing valve core) shut off valve with access port threaded connection for refrigerant hose and dust cap when closed and not in use is also provided.

The main objective of this invention is to provide an improved, safe, efficient and environmentally protective valve device that is installed in the refrigeration system (liquid and suction lines in the condensing unit) as a means to enter or exit the closed system and service the refrigeration system.

The invention, and the system, as claimed, are susceptible to possible changes and/or alterations, (one of which being shown in the annexed drawings, FIG. 5), but such modifications would not alter or defeat the intentions as described or as illustrated in the drawings herein, thereby not limiting or confining same to the preferred embodiment shown.

BRIEF DESCRIPTION OF THE DRAWING

FIG. 4 is a schematic diagram of a refrigeration system with the by pass valves of the present invention connected to the high pressure side of the condenser at point 9 and showing the location of other components of the refrigeration system, i.e., the condenser 20, the liquid line 9, the "Hubbell Double" "By pass Valve", 30, the line to the evaporator expansion valve 4, the expansion valve 21, the evaporator coil 22, the suction line 23 exiting the evaporator and connecting to the condensing unit at the suction shut off valve 24, and the suction line with access port 25.

FIG. 5 depicts another method of making a by pass connection similar to the result obtained by using the valves depicted in FIG. 1 through FIGS. 3, by having two independent valves connected in line and using the same principle as the "Hubbell Double Valve". However, this means probably would be more expensive to manufacture and install than the single unit of the "Hubbell Double Valve".

FIG. 5 shows valves 1 and 2 of FIG. 1 as valves 26 and 27 and shows the transverse manifold 3 of FIG. 2 as 28 intersecting liquid line 9 with a tee at point 29, and shows the access port for valve 27 (1 in FIGS. 1 through 3B) as 31, which is similar to number 5 in the "Hubbell Double Valve".

DESCRIPTION OF THE PREFERRED EMBODIMENT

Like characters of reference in all drawings submitted with this application designate like parts in those figures of the drawings in which they occur.

Figure 1:
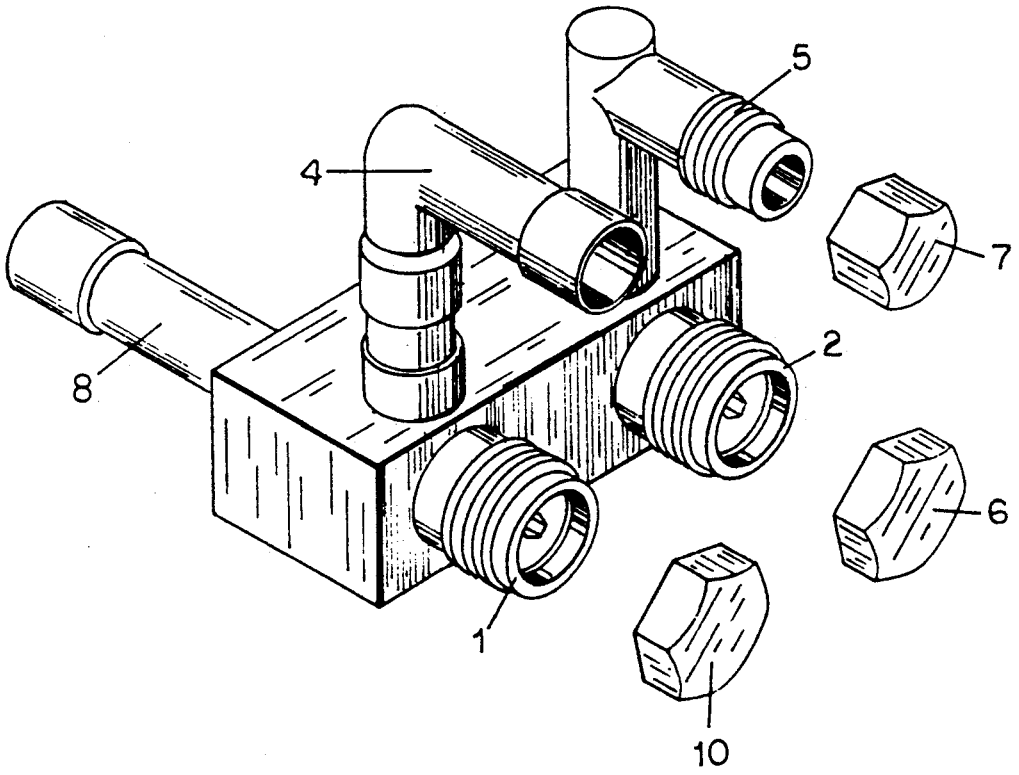
FIG. 1 Perspective view of the "Hubbell Double Valve" in the preferred embodiment showing the liquid shut off valve 1, the charging port shut off valve 2, the by pass connection tubing 3, which is upstream at the intersection of the tubing and the seat of valve number 1, the field connection for the liquid line to the evaporator 4, (which connects to the expansion device in the evaporator), the access port 5, valve cap 10 for shut off valve 1, dust cap 7 for access port 5, inlet connection 8 (stub out), which could be connected to line 9 by a flange, compression or flare fitting or, as illustrated, connected in the line by silver solder, (the liquid line of the condenser unit going to the condenser 9, being shown in FIG. 4) and the valve cap 6 for valve number 2.
Figure 2:
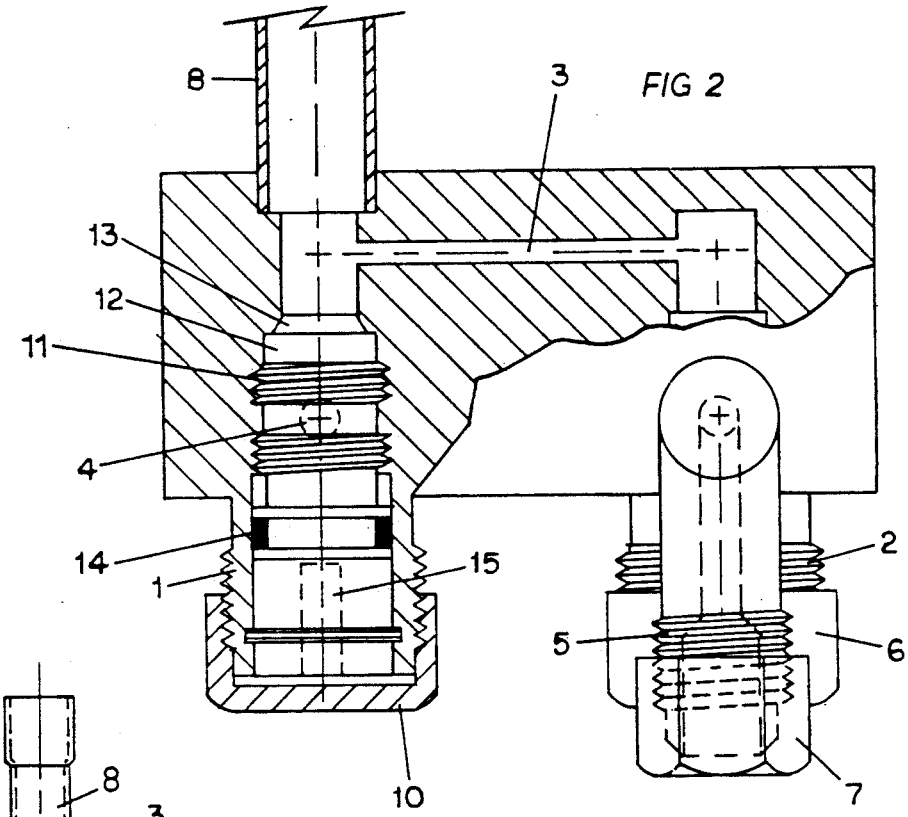
FIG. 2 depicts the core of the liquid shut off valve, number 1, showing the valve stem operator 11, valve seat 12, outlet 4, seat end 13, inlet 8, access port for hoses 5, "O" rings 14, female allen end 15, valve cap 10 on valve 1, dust cap 7 on access port 5 and valve cap 6 on shut off valve 2. Not shown on FIG. 2 are details of valve 2 since the valve is identical to valve 1. (Valve 24 can be any standard back seat valve in the suction line without a Schrader fitting.)
Figure 3:
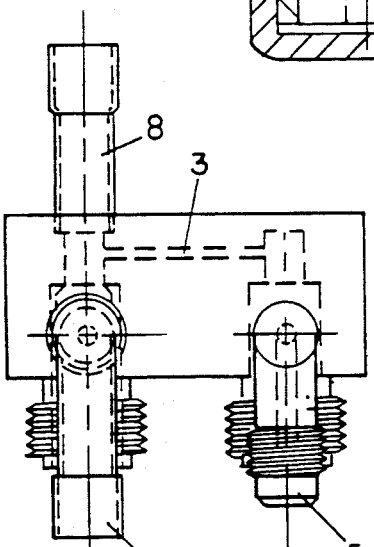
FIG. 3 shows a top view of the bypass system.
Figure 3B:
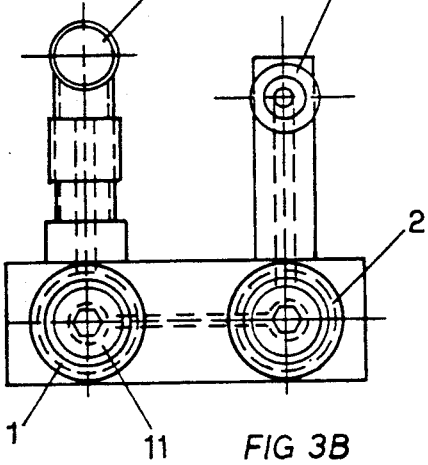
FIG. 3B shows the end view of the by pass valve system.
Figure 3A:
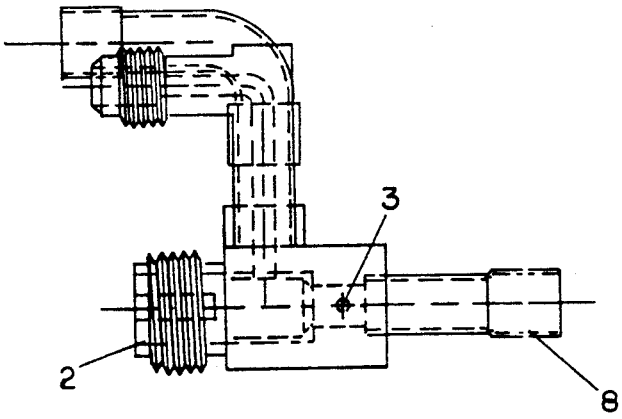
FIG. 3A shows the side view.

Referring now to the details of the invention and, in particular, as illustrated in FIGS. 1, 2, 3 A and 3 B, it will be noted that FIG. 1 illustrates an outside view, in perspective, of a double valve device connected in the liquid flow line 9 in the condenser, which enters valve 1, when it is back seated, and exits at (4), the field connection for the liquid line to the evaporator. FIG. 2 is a drawing depicting the core of valve 1, which is a simple manually operated cut off valve. Number 3 is a passageway from valve 1 to valve 2, constituting a by pass connection, which intersects with valve 1 at a point which is upstream of the seat of valve 1. Thus, when valve 1 is front seated the refrigerant fluid cannot exit valve 1 at field connection 4 but will be allowed a passageway to the by pass connection tubing, 3. Number 2 is a charging port shut off valve, which, as depicted, is parallel to valve 1 and is intersected by the by pass connection passageway or tubing, Number 3, and an access port threaded male connection, Number 5, for a gauge hose. Valves 1 and 2 have valve caps for use when the valves are not being used, numbers 10 and 6 respectively, and the threaded access port male connection, number 5, has a dust cap, Number 7. Number 8 is a "stub out" for an inlet connection and Number 4 has a "stub out" for an outlet (field) connection, which allows the "Hubbell Double Valve" to be connected in the line by either the use of silver solder or a flange, a flare or a compression fitting. When valve 1 is back seated, refrigerant fluid in line 9 can enter valve 1 at stub out 8 and exit at 4. When dust cap 7 is removed and a charging hose is connected to access port 5, and valve 2, which is normally front seated, is back seated, or opened, and valve 1 is front seated, or closed, access to the refrigeration line is obtained and the system can be charged with refrigerant liquid into the high side while the condenser is under a vacuum and the unit is in an off position, and the pressure can be tested or other procedures, as explained hereinafter, can be performed.

OPERATION OF THE PREFERRED EMBODIMENT

Referring now to various operations which can be performed by the use of the "Hubbell Double Valve" or with the method of connecting valves as depicted in FIG. 5 and the method included in Claims herein. Applicant will describe, in detail, three said operations:

A. Entering system for testing and/or charging and exiting the system

B. The "Hubbell Double" vacuum process

C. Storage and transfer of refrigerants

A. Entering system for testing and/or charging and exiting the system

The technician will need, to perform this operation, the following tools and accessories: standard refrigeration high side/low side gauges with charging hoses, Allen socket drives with ratchet wrench and refrigerant drum. Manifold high/low gauges should include an adapter with a two valve connection for refrigerant drum and vacuum tank hoses.

With the unit in operation, attach high pressure gauge hoses to the access port, or charging port valve of the "Hubbell Double Valve" liquid line valve, 5. The low pressure gauge hose connects to the suction port valve 24 and the gauge manifold adapter hose connects to the refrigerant source or drum valve and the second adapter hose connects to the vacuum tank.

With liquid line shut off valve, number 1, in back seated position, open charging port valve, number 2, (back seat) to read the high side pressure of the system.

To exit the system, front seat the port shut off valve, number 2, with the drum valve closed, open the high side gauge valve and the low side gauge valve to induce the refrigerant back into the low side of the system. Shut off the high side gauge valve first and then the low side valve shut off. Then secure in normal operating position both charging port valves (high and low) by front seating said valves into a closed position; then "bleed" the gauge hoses into the vacuum tank.

B. "Hubbell Double Valve" vacuum process

1. Entire system, when the system is void of refrigerant

Make certain that the number 1 valve is in the normal open, or back seated position.

The technician should then go through the same process of connecting the hoses as on the testing and charging procedure (A above) except that the drum hose attaches to the vacuum pump inlet.

Manifold high/low gauges should include an adapter with a two valve connection for refrigerant drum and vacuum tank hoses.

Access port valve 2 should then be back seated and the suction charging port valves 25 opened. Vacuum the lines and, after the process is completed, attach the charging hose to the refrigerant drum valve and, with both gauge valves closed, open the drum valve to purge the charging hose into the vacuum tank. This will allow the refrigerant to be added to the system as a liquid through the liquid line side, with the unit off, or as a vapor through the low side with the unit in operation.

2. Vacuum on separate high or low sides a) High side vacuum

To pull the vacuum on the condensing unit side only (with the charging hose connected to the vacuum pump) front seat the liquid line shut off valve number 1 and back seat the charging port valve number 2 with suction line valve 24 closed (front seated):

b) Low side vacuum

To pull the vacuum on the evaporator side (from liquid line condensing unit exit 4) from valve number 1 through the expansion valve to the suction line service valve entrance 25, front seat the liquid line shut off valve number 1 and front seat the liquid line charging port valve number 2 with suction line valve number 24 in a closed position (front seated) and access port valve 25 open.

c) To exit the system and return to normal operating position

After the unit has been vacuumed, charged and tested, return to normal operating valve positions, i.e., valve number 1 open, back seated, and charging port valve, 2 and 25 closed, (front seated). If 25 is on a standard back seat valve, it must be back seated to close the said valve.

With the refrigerant drum valve closed, back seat the liquid line valve number 1 and front seat the liquid line port valve number 2; back seat the suction line valve 24 on a standard back seat valve, open the gauge valves (high side first, then suction gauge hose valve to induce the remaining refrigerant in the hoses into the system); then, front seat the suction charging port valve number 25 or back seat a standard back seat valve to the closed position and disconnect all hoses as the process is then complete, if using a by pass valve on the suction line in lieu of a standard back seat valve.

C. Storage and transfer of refrigerant

With the unit in operation, in order to salvage the refrigerant in the system, when repairing or replacing there condensing unit section of a system, is as follows:

Attach gauges to respective high, low and refrigerant drum connections, and, after purging the hoses into the vacuum tank, close the refrigerant drum valve (front seated).

With the liquid line valve 1 closed (front seated), open (back seat) the liquid charging port shut off valve, number 2 on the "Hubbell Double Valve", and read the pressure on the manifold high side gauge, while reading the suction pressure on access port 25.

Close (front seat) the suction line service valve 24 after the pump down of the refrigerant into the condensing unit 20 if it has an "old-time" service valve charging port, or, if the suction valve 24 has a "Schrader type" fitting, remove the Schrader core. Shut the condensing unit off after pumping down the refrigerant into the condenser.

Pull the evaporator side of the system on a vacuum through the suction port (with the Schrader core removed).

With the drum and vacuum tank valves closed open the high side gauge valve; then the low side gauge valve, allowing the refrigerant to flow through the gauge manifold into the suction line at 25 of line 23 into the evaporator. When the liquid refrigerant has flowed into and filled the evaporator and the liquid and suction lines, close (front seat) the manifold gauges and liquid line port valve 5.

If possible, run the unit to pump the refrigerant into the evaporator side (through the suction line 23 at 25).

If the unit is unable to run, in order to store the liquid refrigerant in the evaporator section of the system, use an auxiliary refrigerant pump, or reclaim unit.

If any refrigerant remains in the condensing unit section, evacuate an empty refrigerant drum on a vacuum and induce the remaining refrigerant into the drum (or use a reclaim unit).

After the repairs are completed, open the liquid line valve 1 allowing the refrigerant to migrate back into the condenser from the evaporator.

When the pressure equalizes on both sides of the system (condenser/evaporator) the suction service valve 24 must be opened to allow the unit to be operational. With the unit running, the refrigerant charge can be balanced.

When refrigerant is in a system with a compressor "burn out", the entire charge will have to be filtered and passed through a reclaiming process. After filtering, the refrigerant will have to be tested to determine if its properties are still retained in order to reuse same as per E.P.A. standard regulations.

I claim:

1. A device containing a double valve manifold with a by pass of the shut off valve in the main flow refrigerant line between the condenser and evaporator coils of a closed refrigeration system, comprising, a longitudinal main flow manifold containing a manually operated shut off valve through which compressible evaporative refrigerants flow between the condenser and evaporator coils of a closed refrigeration system and having an entrance and exit to a passageway for the flow of said refrigerant through the said manifold and comprising, a second longitudinal manifold containing a manually operated shut off valve that is generally parallel to the said firstly described main flow manifold and shut off valve with an external threaded access port thereon, without a Schrader valve core therein, extending from said second longitudinal manifold, and a transverse tubular manifold between the first and secondly described longitudinal manifold valves, on a generally ninety degree angle, which intersects the first and secondly described manifold valves on the upstream side of the seat thereof, which provides a means to infuse in and to extract refrigerants from a closed refrigeration system through the threaded access port of the secondly described manifold, and then through the tubular transverse manifold, intersecting the first and secondly described manifolds, into the firstly described manifold, upstream of the seat of its shut off valve, allowing a by pass of the main flow shut off valve.

2. Two independent valve manifolds providing a means for a by pass of the shut off valve in the main flow refrigerant line between the condenser and evaporator coils of a closed refrigeration system, comprising, a longitudinal main flow manifold containing a manually operated shut off valve through which compressible evaporative refrigerants flow between the condenser and evaporator coils of a closed refrigeration system and having an entrance and exit to a passageway for the flow of said refrigerant through the said manifold and comprising, a second longitudinal manifold containing a manually operated shut off valve that is generally parallel to the said firstly described main flow manifold and shut off valve with an external threaded access port thereon, without a Schrader valve core therein, extending from said second longitudinal manifold, and by means of a tee in the main flow refrigerant line, the refrigerant line connects the first and second manifold valves on the upstream side of the seats thereof, which provides a means to infuse in and to extract refrigerants from a closed refrigeration system through the threaded access port of the secondly described manifold, and then through the tee that intersects the main flow refrigerant line upstream of the seat of the firstly described shut off manifold valve, allowing a by pass of the main flow shut off valve.

3. A method of entering, for testing and charging, and exiting a closed refrigeration or air conditioning system having a compressor, a condenser on the high pressure side of the compressor, an evaporator on the low pressure side of the compressor, and a double valve manifold on the refrigerant liquid line connected with a by pass tubular connection on the upstream side of the valve seats thereof, comprising the steps of:

a) when entering the system, while the unit is in operation, attach high pressure gauge hose to the access port of the by pass manifold valve, the low pressure gauge hose to the suction port valve, the gauge manifold adapter hose to the refrigerant source and the second adapter hose to the vacuum tank, and, with liquid line shut off valve in open position, open the charging port valve to read the high side pressure of the system, and b) in exiting the system, with the unit in operation or when it is idle, close the access port valve and, with the drum valve closed, open the high side gauge valve first and then the low side gauge valve to induce the refrigerant back into the low side of the system; then secure, in normal operating position, both charging port valves to a closed position and then bleed the gauge hoses into the vacuum tank.

4. A method of executing a vacuum process of a closed refrigeration or air conditioning system having a compressor, a condenser on the high pressure side of the compressor, and evaporator on the low pressure side of the compressor and a double valve manifold on the refrigerant liquid line connected with a by pass tubular connection thereof on the upstream side of the valve seats, comprising the steps of:

a. with the main flow liquid line valve in the normal open position with the unit off and the system minus refrigerant, attach high pressure gauge hose to the access port of the by pass manifold valve, the low pressure gauge hose to the suction port valve, the gauge manifold adapter hose to the refrigerant source drum and the second adapter hose to the vacuum pump, and, with liquid line shut off valve in open position, open the suction charging port valve to read the vacuum, and b. with the liquid line access port valve open and the suction charging port valves opened, vacuum the lines, and c. to vacuum the condensing unit side only, with the charging hose connected to the vacuum pump and the high side manifold gauge hose connected to the liquid line access port by pass valve, close the liquid line shut off valve and open the charging port valve with the suction line valve closed and then proceed to initiate the vacuum pump operation, and d. to vacuum the evaporator side from the condensing unit valves through the expansion valve and evaporator coils to the suction line service valve, close the liquid line main shut off valve, the liquid line charging port valve and the suction line service valve and open the suction line service valve access port valve and proceed to initiate the vacuum pump operation through the low side manifold gauge hose, and e. to exit the system and return to normal operating position, after the unit has been vacuumed, return to normal operating valve positions, i.e., the main flow valve open and the charging port valve closed and, with the refrigerant drum valve closed, connect adapter valve hose to vacuumed tank, open refrigerant drum valve, purge hoses into vacuum tank and then system is ready for recharging.

5. A method of storing and transferring refrigerants into either the condenser or evaporator section of a closed refrigeration or air conditioning system having a compressor, a condenser on the high pressure side of the compressor, and evaporator on the low pressure side of the compressor and a double valve manifold on the refrigerant liquid line connected with a by pass tubular connection on the upstream side of the valve seats thereof, comprising the steps of:

a. with the unit in operation, in order to salvage the refrigerant in the system, when repairing or replacing the condensing unit section of a system, attach gauges to respective high, low and refrigerant drum connections, and, after purging the hoses into the vacuum tank, close the refrigerant drum valve and, with the liquid line valve closed, open the liquid charging port shut off valve and read the pressure on the manifold high side gauge and the suction line pressure on the suction access port valve, and then close the suction line service valve and, after transferring the refrigerant into the condensing unit, close the suction service valve and turn the condensing unit off, and b. in order to transfer the liquid refrigerant from the condenser into the evaporator side of the system the operator will then vacuum the evaporator side of the system through the suction port, with the drum and vacuum tank valves closed and open the high side gauge valve, then the low side gauge valve and, allowing the liquid refrigerant to flow through the gauge manifold into the suction line and into the evaporator, and when the liquid refrigerant has flowed into and filled the evaporator and the liquid and suction lines, operator will close the manifold gauges and liquid line port valve, and c. if the unit is unable to run, in order to store the liquid refrigerant in the evaporator section of the system, use an auxiliary refrigerant pump, or reclaim unit, and d. if any refrigerant remains in the condensing unit section, evacuate an empty approved refillable refrigerant drum on a vacuum and induce the remaining refrigerant into the drum, or use a reclaim unit, and e. after the repairs and/or replacements are completed, open the liquid line valve to allow the refrigerant to migrate back into the condenser from the evaporator, and f. when the pressure equalizes on the condenser and evaporator sides of the system, open the suction service valve to allow the unit to be operational, and, with the unit running, the refrigerant charge can be balanced, and g. when the refrigerant is in a system with a compressor "burn out", the entire charge will have to be filtered and passed through a reclaiming process and then tested to determine if its properties are still retained in order to reuse same as per United States Environmental Protection Agency standard regulations.

* * * * *

UNITED STATES PATENT AND TRADEMARK OFFICE

CERTIFICATE OF CORRECTION

PATENT NO. : 5,172,557
DATED : December 22, 1992
INVENTOR(S) : Paul J. Hubbell, Jr.

It is certified that error appears in the above-indentified patent and that said Letters Patent is hereby corrected as shown below:

On the title page, "5 claims" should read--3 claims--.

Abstract, column 2, line 8, delete "and a method for storage".

Figure 5, is deleted in its entirety.

Column 2, lines 60-65, delete "(4) the by pass value allows the refrigeration technician to place all of the refrigerant fluid in the condenser unit which then can be transferred to the evaporator section of the system, thus allowing the repair or work on either system separately;"
line 65, change "(5)" to -- (4) --;
line 68, change "(6)" to -- (5) --.

Column 3, lines 37-38, delete "(one of which being shown in the annexed drawings, Figure 5)".

Column 4, lines 15-28, delete in their entirety.

Column 5, line 12, change "three" to --two of--.
line 16, delete "C. Storage and transfer of refrigerants".

Column 6, lines 37-68, delete in their entirety.

Column 7, lines 1-17, delete in their entirety.

Column 7, lines 58-68 and Column 8, lines 1-19, Claim 2, delete in its entirety.

UNITED STATES PATENT AND TRADEMARK OFFICE

CERTIFICATE OF CORRECTION

PATENT NO. : 5,172,557

DATED : December 22, 1992

INVENTOR(S) : Paul J. Hubbell, Jr.

It is certified that error appears in the above-indentified patent and that said Letters Patent is hereby corrected as shown below:

Column 9, lines 23-42, and column 10, lines 1-42, claim 5, delete in its entirety.

Signed and Sealed this

Twenty-eight Day of March, 1995

Bruce Lehman

*Attest:*

BRUCE LEHMAN

*Attesting Officer*

*Commissioner of Patents and Trademarks*